United States Patent [19]

Rabinow

[11] Patent Number: 4,825,672

[45] Date of Patent: May 2, 1989

[54] KEY FOR FLAT TUMBLERS

[76] Inventor: Jacob Rabinow, 6920 Selkirk Dr., Bethesda, Md. 20817

[21] Appl. No.: 152,405

[22] Filed: Feb. 4, 1988

[51] Int. Cl.[4] ..... E05B 15/14; E05B 19/06

[52] U.S. Cl. ..... 70/377; 70/406; 70/409

[58] Field of Search ..... 70/376, 377, 392, 409, 70/405–407

[56] References Cited

U.S. PATENT DOCUMENTS

| | | | |
|---|---|---|---|
| 799,666 | 9/1905 | Oleschak | 70/376 X |
| 1,204,545 | 11/1916 | Christoph | 70/377 X |
| 1,287,882 | 12/1918 | Christoph | 70/409 X |
| 1,384,179 | 7/1921 | Christoph | 70/377 X |
| 1,406,574 | 2/1922 | Mantanfel | 70/377 X |
| 1,725,557 | 8/1929 | Baird | 70/377 X |
| 2,035,181 | 3/1936 | Molinare | 70/377 X |
| 2,039,126 | 4/1936 | Svoboda | 70/409 |
| 2,696,727 | 12/1954 | Schlabach | 70/377 X |
| 3,035,433 | 5/1962 | Testa | 70/409 X |
| 3,499,304 | 3/1970 | Naujoks | 70/406 |

*Primary Examiner*—Robert L. Wolfe
*Assistant Examiner*—Suzanne L. Dino

[57] ABSTRACT

A double bitted key is provided for locks of the type using flat tumblers. There is a double bit for each tumbler. Each double bit corrrectly sets its complementary tumbler. Each bit includes a flat surface extending along a surface of the key. The key has one or more peaks and valleys. When a valley is between two peaks it is a full valley and its flat surface is about three times as long as the thickness of a tumbler. When a valley is between a peak and another valley it is called a hybrid peak-valley and its flat surface has a length along the key which is approximately double the thickness of a tumbler. A peak has a flat surface extending along the key for a distance about equal to the thickness of a tumbler.

9 Claims, 2 Drawing Sheets

KEY FOR FLAT TUMBLERS

BACKGROUND OF THE INVENTION

A very common type of lock in widespread use today consists of a stationary outer cylinder and a rotatable plug. The plug has a number of transverse passages, each containing a tumbler. In some cases each tumbler is kept in its inoperable position by a spring and the key acts against the spring so as to position the tumbler into the desired position so that the lock can be opened.

In other locks, the tumblers are free to be positioned by a double bitted key. Such tumblers do not use springs. It is in relation to such locks that this invention is made.

SUMMARY OF THE INVENTION

While the patent art of locks and keys is very extensive, there is little or no discussion of the geometry of simple keys such as those used in flat-tumbler locks. One object of this invention is the design of a flat key that is easy to manufacture by present-day key-cutting equipment. A second object is to specify a key that will locate simple flat tumblers with high accuracy. A third object is to produce the most "gentle" transitions for the tumbler and the key as it is passed thru them. A fourth object is to produce a key such that the inevitable wear on the tumblers and the key will not reduce the accuracy of tumbler positioning. At each tumbler location the double bitted key has two flat bits (faces) to engage the tumbler. Assuming that the sides of the key are vertical, these flat bit faces are horizontal and there is such a face at the top and bottom of the key at each tumbler location. These flat bit faces at one tumbler location are connected by a portion of the key having parallel and sloping sides with the next tumbler location. One of the two flat bit faces at least one tumbler location is, however, extended by at least the thickness of the tumbler, toward the next tumbler location.

To facilitate the understanding of this invention, I call the two opposing flat faces of a double bitted key as a "peak" and a "valley." The illustration and text of this application will make these terms clear.

When a key is fully inserted into a lock, each tumbler is positioned by a pair of opposed flat faces, usually one is a peak and the other a valley. This is not necessarily always so because a key may position two or three adjacent tumblers to the same height. In this case these may not be a peak and a valley at each tumbler position.

The extent of the flat surface of a peak or a valley may depend on several factors, the most important of them being the accuracy of the construction of the lock. Because the longitudinal position of the key may not be located with great precision, and because the tumbler may be very thin, and its transverse passage rather loose, the flats of the key are usually much longer than the thickness of the tumbler.

Making the flats longer then necessary, however, causes the transitions between successive flats become steep.

It should be understood then that the length of the flats in the peaks and valleys of a key are matters of engineering judgement. In this particular case I show such flats as slightly larger than the widths of the tumblers.

This invention applies equally well to keys when the flats are shorter than, equal to, or larger than the thickness of the tumblers.

DETAILED DESCRIPTION OF THE DRAWINGS

Figure 1:
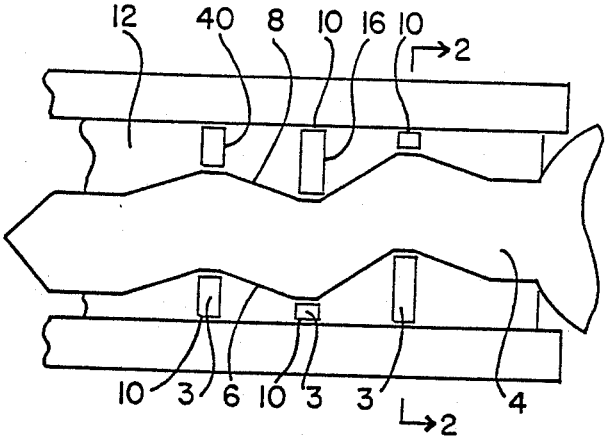
FIG. 1 PRIOR ART
FIG. 1 shows a longitudinal cross section of a typical lock using my invention.
Figure 2:
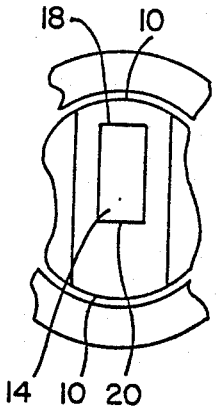
FIG. 2 PRIOR ART
FIG. 2 shows one tumbler 10 of FIG. 1.

The usual simple lock such as shown in FIG. 1 uses a set of flat-plate tumblers 32 that are positioned by the typical key 4. The key 4 is cut on both edges 6 and 8 to position the tumblers 32 so that their outside edges 10 and 10 (see also FIG. 2) line up with the outside surface of the plug 12. The plug 12 can now be turned by the key.

The tumblers 32 are usually made of sheet brass and the opening 14 and the key 4 is punched out so that the inner edges of the opening 14 are substantially perpendicular to the sides 16 (FIG. 1).

The shape of the key 4 becomes critical if easy insertion and removal of the key is desired. There is one expedient that has been used to achieve this, and that is to make the opening 14 in the tumbler oversize. This reduces the accuracy and safety of the lock.

Figure 3:
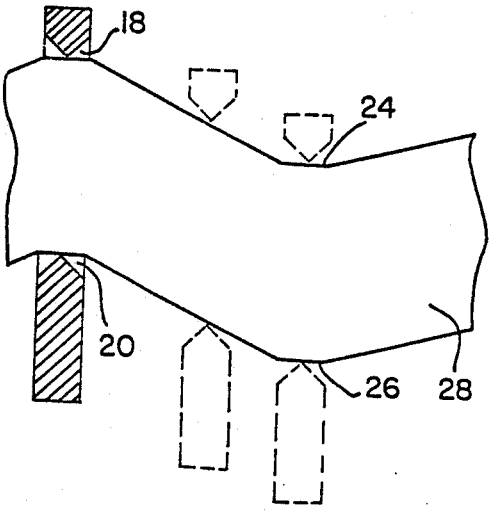
FIG. 3 shows a typical key and a set of tumblers having sharpened edges in their slots.
Figure 4:
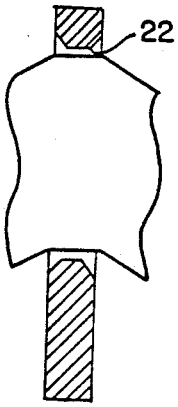
FIG. 4 shows the effect of wear on the tumblers.

Another expedient that I have conceived is to sharpen the top 18 and bottom 20 edges of the opening 14 in each tumbler, (FIG. 2) as shown in FIG. 3. This causes rapid wear on the points 18 and 20 as shown in FIG. 4. The resulting accuracy of tumbler positioning suffers and many large tolerances have to be built into the lock to make it work.

Still another expedient is to make the sloping surfaces between critical locations of the key (such a 24 and 26 in FIG. 3) closer together than necessary. This causes some violent cam action between the key and the tumblers and causes more wear.

Figure 5:
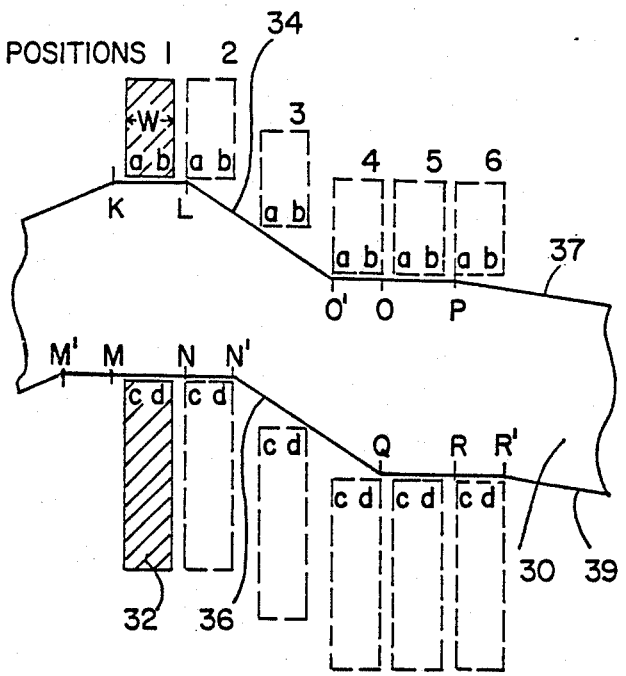
FIG. 5 shows the key of my invention and a single tumbler as they move relatively to each other.
Figure 6:
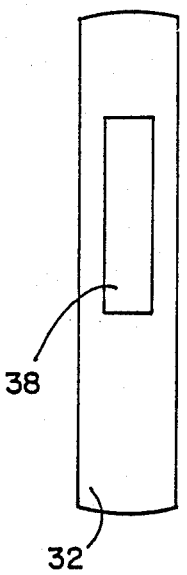
FIG. 6 shows tumbler 32 of FIG. 7.

In order to overcome these difficulties I have evolved a preferred novel shape of a key that is intended to cooperate with flat tumblers with square edged holes, such as shown in FIGS. 1, 2, 5 and 6. This preferred novel key shape is shown in FIG. 5.

In FIG. 5, I show a key 30 and one tumbler 32. For the sake of clarity I show different positions of the tumbler 32 as if it moves from left to right, assuming for purposes of discussion that key 30 is stationary. In practice, of course, the tumblers stand still longitudinally while the key slides thru them. The key 30 has two critical sections labeled K-L M-N and O-P Q-R. These are the locations where a tumbler such as 32 must be located to open the lock.

As stated earlier the dimension K-L and M-N and 0-P and Q-R can be larger, equal to, or smaller than the thickness W of the tumbler 32.

For convenience, I show these dimensions slightly greater than the thickness W of the tumbler 32.

Position 1 shows the tumbler 32 over the left critical portion of the key 30. Assume now that the tumbler 32 is moved to the right (as viewed in FIG. 5). It must move down (as seen in FIG. 5) to reach position 5, but it cannot start to do so until it reaches position 2. At this point corner a of tumbler 32 can start to slide down along the top slanted surface 34 of the key 30. At the same time corner d of tumbler 32 can start to slide down along the lower slanted surface 36 of the key 30. This requires that the surface M-N of the key must be extended so that the distance N—N′ must be equal to the dimension a-b or c-d of the tumbler 32.

As the tumbler 32 moves further to the right, it will assume the position 3, as shown. The corners a and d will remain in contact with the key surfaces 34 and 36. The tumbler 32 will reach position 4 where its edge a-b will rest on the surface 0′—0 of the key 30. This surface O′O must also be at least equal in length to the thickness W of the tumbler 32. The tumbler 32 can now slide over the key 30 to the position 5.

It will be noted that the slanted edges 34 and 36 are parallel straight lines. This results in the most gentle cam ation on the tumbler 32 as it moves from one required position to another.

Assume now that the tumbler 32 must continue to move to the right as seen in FIG. 5. I show the key 30 as it would look if it were to continue downward to the right of surfaces 0-P and Q-R. An identical analysis shows that the tumbler 32 must slide horizontally to the right and assume position 6 before it could begin to slide down along surfaces 37 and 39.

It will now be seen that a full peak such as K-L can be of any desired length. I show it as slightly larger than the width W of tumbler 32.

The full valley, such as shown next to flat M-N of the 0 key 30 has a length of M-N (equal to K-L), plus M′—M, plus N—N′, or the arbitrary flat K-L plus two times W.

The hybrid peak-valley, O-P will have a length of W plus OP. The hybrid peak-valley at Q-R will have a length Q-R plus R—R′, or Q-R plus W.

It should be noted that the opening 38 in the tumbler 32 is at all times in intimate contact with the surfaces 34–36 and 37–39 of the key 30. This results in a smooth action during the insertion and removal of the key.

Consider now the wear between the key 30 and the tumbler 32. Because there is little or no force necessary to slide the key 30 (in an actual lock) when the tumbler is located in positions 1 and 5 (in FIG. 5) there is little wear.

Figure 7:
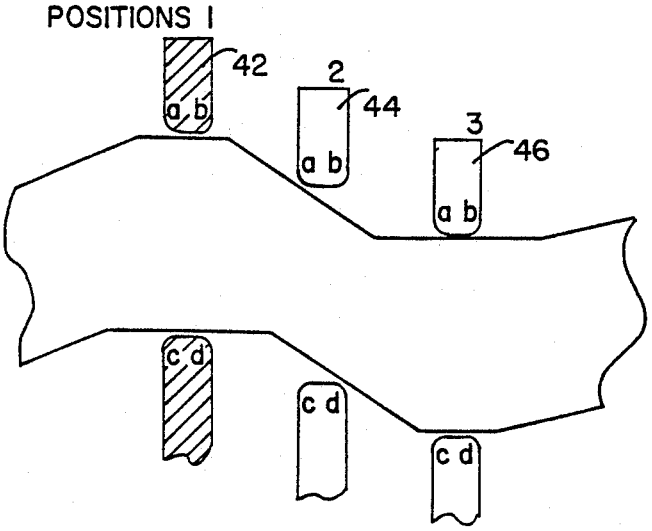
FIG. 7 illustrates the key and tumbler of the present invention after substantial usage.

However, when the tumbler 32 is moved along the key 30 surfaces 34 and 36, and 37 and 39, there is considerable friction between them, and the corner a and d (in FIG. 5) will be subject to wear. In general, corners like a, b, c, and d will be worn in such locks. I show this condition in the tumblers 42, 44 and 46 in FIG. 7.

It should be noted that the flat area between the corners is subject to little wear and while the tumblers will be "loose" when they are in position 2 (FIG. 7), they will still be tight in positions 1 and 3. Thus, positions 1 and 3 are the positions where tumblers of an actual lock according to the invention, would be accurately located relative to a key such as key 30.

While I explained the design of the key in the embodiment of the simple lock of FIG. 1, it should be understood that such a key and tumbler relationship will apply to more complex locks, for example, the lock of my co-pending patent application No. 071,417 filed July 9, 1987, which is incorporated by reference as a lock with which the key of the present application may be used.

The vertical dimension of the key (assuming its side walls are parallel and vertical) is smaller along sidewalls 34 and 36 than at the key positions 1 and 5.

It is understood that in an actual lock there would be tumblers 32 at positions 1 and 5 of FIG. 5 and the key 30 would pass through the perforations 38 of the tumblers 32 to position the tumblers in the correct vertical positions to enable the lock to open. The perforations 38, in the several tumblers 32 of the lock, would be moved up and down by the peaks and valleys of the key as the key was inserted into the lock.

According to the invention the double-bitted key has full peaks, hybrid peaks-and-valleys and full valleys. In FIG. 5, key portion KL is a full peak. At full peaks of the key, the length (distance along the length of the key) of the bit, for example, the bit KL is about equal to the physical thickness of a tumbler 32. Where there is a full valley (a valley between two peaks), such as the full valley MN at the bottom of the key as shown at position 1 of FIG. 5, the flat portion MN should be about three times as long as the thickness of a tumbler. If a valley is between a peak and another valley, it is called a hybrid peak-and-valley, and the length of the flat portion of the bit at such hybrid-peak-and-valley should be about double the width of a tumbler. The lengths of the flat portions may vary somewhat from the foregoing.

The full peak KL and the full valley M′N′ constitute complementary bits of a first double bit of the key. Similarly, hybrid-peak -and-valley O′P and hybrid-peak-and-valley QR′ constitute complementary bits of a second double bit of the key.

In its preferred form, a lock operated by my new key would have five tumblers 32, each with a perforation or opening 38. All openings 38 may be of the same size although the openings in the several tumblers would preferably be positioned at different vertical positions. All tumblers 32 may have the same outside dimensions, and may have the same thickness.

In this specification, including the claims, the word valley is generic and is broad enough to include either a hybrid peak and valley, or, a full valley.

I claim to have invented:

1. A double-bitted key for opening a lock that has tumblers at least a plurality of which have a thickness W, and an opening of a length L, comprising:

said key having a first double-bit with two complementary bits, one of which is a full peak and one of which is a full valley, spaced apart by a distance slightly smaller than L, said key also having a second double-bit having two complementary bits, both of which are a hybrid peak and valley, spaced apart by a distance slightly smaller than L, said key having side walls, means connecting said side walls, and forming a first surface that includes and defines said full peak and one hybrid-peak-and-valley, and also forming a second surface that includes and defines said full valley and the other hybrid-peak-and-valley, said first surface having a first flat area and of a given length forming said full peak and a second flat area forming said one hybrid-peak-and-valley by extending longitudinally of the key for said given length plus W, said second surface having a flat area forming said full valley by extending for a distance equal to said given length plus 2W, and forming said other hybrid-peak-and-valley by extending for a distance equal to said given length plus W.

2. A double bitted key as defined in claim 1, comprising:

means connecting the first and second double bits and for providing a smooth motion of said tumblers when said double-bits move through the openings in said tumblers.

3. A double bitted key as defined in claim 1, comprising:

said first surface including a portion connecting said full peak to said one hybrid-peak-and-valley, said second surface including a portion connecting said full valley to said other hybrid-peak-and-valley, said portions being parallel to each other and comprising means for providing a smooth motion of said tumblers when said double bits move through the openings in said tumblers.

4. A double bitted key as defined in claim 3, comprising:

means connecting the first and second double bits and for providing a smooth motion of said tumblers when said double-bits move through the holes in said tumblers.

5. A double bitted key as defined in claim 4, comprising:

means connecting the first and second double bits and for providing a smooth motion of said tumblers when said double-bits move through the holes in said tumblers.

6. A double-bitted key for opening a lock that has tumblers at least a plurality of which have a thickness W, and an opening of a length L, comprising:

said key having a first double-bit with first and second complementary bits, spaced apart by a distance slightly smaller than L, said key having side walls, means connecting said side walls, and forming a first surface that includes and defines said first bit of said first double bit and a first hybrid-peak-and-valley, said means also forming a second surface that includes and defines said second bit of said first double bit and a second hybrid-peak-and-valley, said first hybrid-peak-and-valley and said second hybrid-peak-and-valley constituting the bits of a second double bit, said bits of said second double bit being spaced apart by a distance slightly smaller than L, said first surface having a first flat area forming said first bit of said first double bit, and a second flat area forming said first hybrid-peak-and valley by extending longitudinally of the key for a distance of about 2 W, said second surface having a flat area forming said second bit of said first double bit, and forming the second said hybrid-peak-and-valley by extending for a distance of about 2 W.

7. A double bitted key as defined in claim 6, comprising:

said first surface including a portion connecting said first bit of said first double bit to said one hybrid-peak-and-valley, said second surface including a portion connecting said second bit of said first double bit to said other hybrid-peak-and-valley said portions being parallel to each other and comprising means for providing a smooth motion of said tumblers when said double bits move through the openings in said tumblers.

8. A double-bitted key for opening a lock that has tumblers at least a plurality of which have a thickness W, and an opening of a length L, comprising:

said key having a first double-bit with two complementary bits, one of which is a full peak and one of which is a full valley, spaced apart by a distance slightly less than L, said key also having a second double-bit having first and second complementary bits spaced apart by a distance slightly smaller than L, said key having side walls, means connecting said side walls, and forming a first surface that includes and defines said full peak and also includes and defines the first bit of said second double bit, said means also forming a second surface that includes and defines said second bit of said second double bit, said first surface having a first flat area and of a given length forming said full peak, and a second flat area forming said first bit of said second double bit, said second surface having a flat area forming said fully valley by extending a for a distance equal to said given length plus 2 W, and also forming said second bit of said second double bit.

9. A double bitted key as defined in claim 8, comprising:

said first surface including a portion connecting said full peak to said first bit of said second double bit, said second surface including a portion connecting said fully valley to said second bit of said second double bit, said portions being parallel to each other and comprising means for providing a smooth motion of said tumblers when said double bits move through the openings in said tumblers.

* * * * *